US006520811B2

(12) United States Patent
Mitani et al.

(10) Patent No.: US 6,520,811 B2
(45) Date of Patent: Feb. 18, 2003

(54) TERMINAL FITTING

(75) Inventors: Yumi Mitani, Yokkaichi (JP); Masaaki Tabata, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/026,039

(22) Filed: Dec. 21, 2001

(65) Prior Publication Data

US 2002/0086590 A1 Jul. 4, 2002

(30) Foreign Application Priority Data

Dec. 21, 2000 (JP) ..... 2000-388659

(51) Int. Cl.[7] ..... H01R 11/22
(52) U.S. Cl. ..... 439/852; 439/843; 439/845
(58) Field of Search ..... 439/845, 849–852, 439/843, 595, 597, 598, 752, 871, 872, 873

(56) References Cited

U.S. PATENT DOCUMENTS 5,443,592 A * 8/1995 Ittah et al. ..... 439/851
5,540,603 A * 7/1996 Fujiwara ..... 439/851
5,577,928 A * 11/1996 Duclos ..... 439/290
5,666,723 A 9/1997 Ohtaka et al. ..... 29/874
5,707,259 A * 1/1998 Ishizika et al. ..... 439/852
5,716,245 A * 2/1998 Kameyama et al. ..... 439/852
5,941,741 A * 8/1999 Dobbelaere et al. ..... 439/852
6,050,862 A * 4/2000 Ishii ..... 439/843
6,305,993 B1 * 10/2001 Heimueller ..... 439/852

FOREIGN PATENT DOCUMENTS

JP 8-306420 11/1996

* cited by examiner

*Primary Examiner*—P. Austin Bradley
*Assistant Examiner*—Briggitte R. Hammond
(74) *Attorney, Agent, or Firm*—Anthony J. Casella; Gerald E. Hespos

(57) ABSTRACT

A terminal fitting has a bottom wall (15). A curved portion (21) is folded back at a front end (15F) of the bottom wall (15). A touching portion (22) extends back from the curved portion (21) and is in contact with the bottom wall (15). A contact portion (23) extends back from the touching portion (22). The contact portion (23) is displaced resiliently about the rear end (22R) of the touching portion (22) in response to contact by a male tab (T), and a resilient restoring force of the contact portion (23) ensures high contact pressure. The curved portion (21) is not resiliently deformed when the contact portion (23) is displaced. Thus, there is no possibility of concentrating a stress on the curved portion (21) and the height of a terminal fitting can be reduced by reducing a radius of curvature of the curved portion (21).

6 Claims, 10 Drawing Sheets

TERMINAL FITTING

BACKGROUND OF THE INVENTION

1. Field of the Invention

The invention relates to a miniaturized terminal fitting.

2. Description of the Related Art

A known miniaturized terminal fitting is disclosed in Japanese Unexamined Patent Publication No. 8-306420. This terminal has a rectangular tubular portion with a resilient contact piece inside. A male tab can be inserted into the rectangular tubular portion, and thus can be brought resiliently into contact with the resilient contact piece. The resilient contact piece is comprised of a curved portion that extends back from the front end of the bottom wall of the rectangular tubular portion and a contact portion that extends back from the curved portion substantially parallel to the bottom wall from the curved portion. The contact portion is located on an entrance path of the male tab and is displaced downward substantially about the curved portion when the male tab is connected. As a result, the radius of curvature of the curved portion is reduced, and a specified contact pressure can be ensured between the contact portion and the male tab by this resiliently restoring force.

There are advantages to reducing the height of a terminal fitting that has such a resilient contact piece. A height reduction of such a terminal fitting could be achieved by reducing the radius of curvature of the curved portion of the resilient contact piece. However, stress disadvantageously concentrates on a curved portion that has had its radius of curvature reduced.

In view of the above, an object of the present invention is to make an entire terminal fitting smaller while avoiding concentration of a stress on a resilient contact piece.

SUMMARY OF THE INVENTION

The invention is directed to a terminal fitting that has a cantilever-shaped resilient contact piece with can be brought into contact with a tab of a mating terminal. The resilient contact piece comprises a curved portion folded back at an end of a support plate. A touching portion extends further from an extending end of the curved portion and is held at least partly in contact with the support plate. A contact portion extends further from an extending end of the touching portion and is spaced from the support plate. The contact portion can be brought into contact with the tab.

The contact portion is displaced substantially about the touching portion and toward the support plate when the resilient contact piece is connected with the tab. More particularly the displacement of the contact portion primarily involves a deformation of a section that connects the touching portion and the contact portion. A contact pressure can be ensured between the resilient contact piece and the tab by the resilient restoring force of the resilient contact piece. The curved portion is not deformed resiliently when the contact portion is displaced, and hence there is no possibility of concentrating a stress on the curved portion. Accordingly, the height of the terminal fitting can be reduced without creating a concentration of stress on the curved portion.

The touching portion preferably is held substantially in close contact with the support plate portion over its entire length along its extending direction.

The contact portion may be displaced about the extending end of the touching portion while resiliently deforming the extending end of the touching portion.

An end area of the support plate opposed to both the curved portion and the touching portion preferably is deformed resiliently when the touching portion is deformed. Thus, concentration of a stress on the touching portion can be moderated.

One end of the terminal fitting preferably defines a rectangular tube that comprises the support plate and two opposed side plates that extend continuously up from opposite side edges of the supporting plate. Slits are formed at the end of the rectangular tube between the support plate and the side plates. The slits make an end area of the support plate resiliently deformable.

The side plates at the opposite sides of the curved portion and the touching portion protect the curved portion and the touching portion from interference of external matter.

The resiliently deformable area is formed at least partly by causing a portion of the support plate to project from side walls without providing the side walls at the opposite sides of the curved portion and the touching portion.

The resilient deformable area of the support plate extends from the end of the support plate to a supporting point for the displacement of the contact portion. The supporting point is located in the touching portion.

Since the supporting points for the resilient deformation of the support plate and for the displacement of the contact portion are at the same position. Thus, the touching portion does not separate from the support plate and, the curved portion does not undergo a resilient deformation.

The contact portion may comprise an embossment for contacting the tab. A wall opposed to the support plate also may comprise an embossment. The embossments of the wall and the contact portion preferably are spaced by a distance smaller than the width of the tab to be inserted therebetween.

The support plate preferably comprises an auxiliary spring portion that contacts the contact portion when the contact portion is deflected by the contact with the tab. The auxiliary spring portion preferably cantilevers in a direction different from the contact portion.

The projecting distance of the curved portion preferably is less than the projecting distance of the contact portion.

The contact portion preferably comprises an elongated portion that is sloped or angled down to approach the support plate along an extending direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
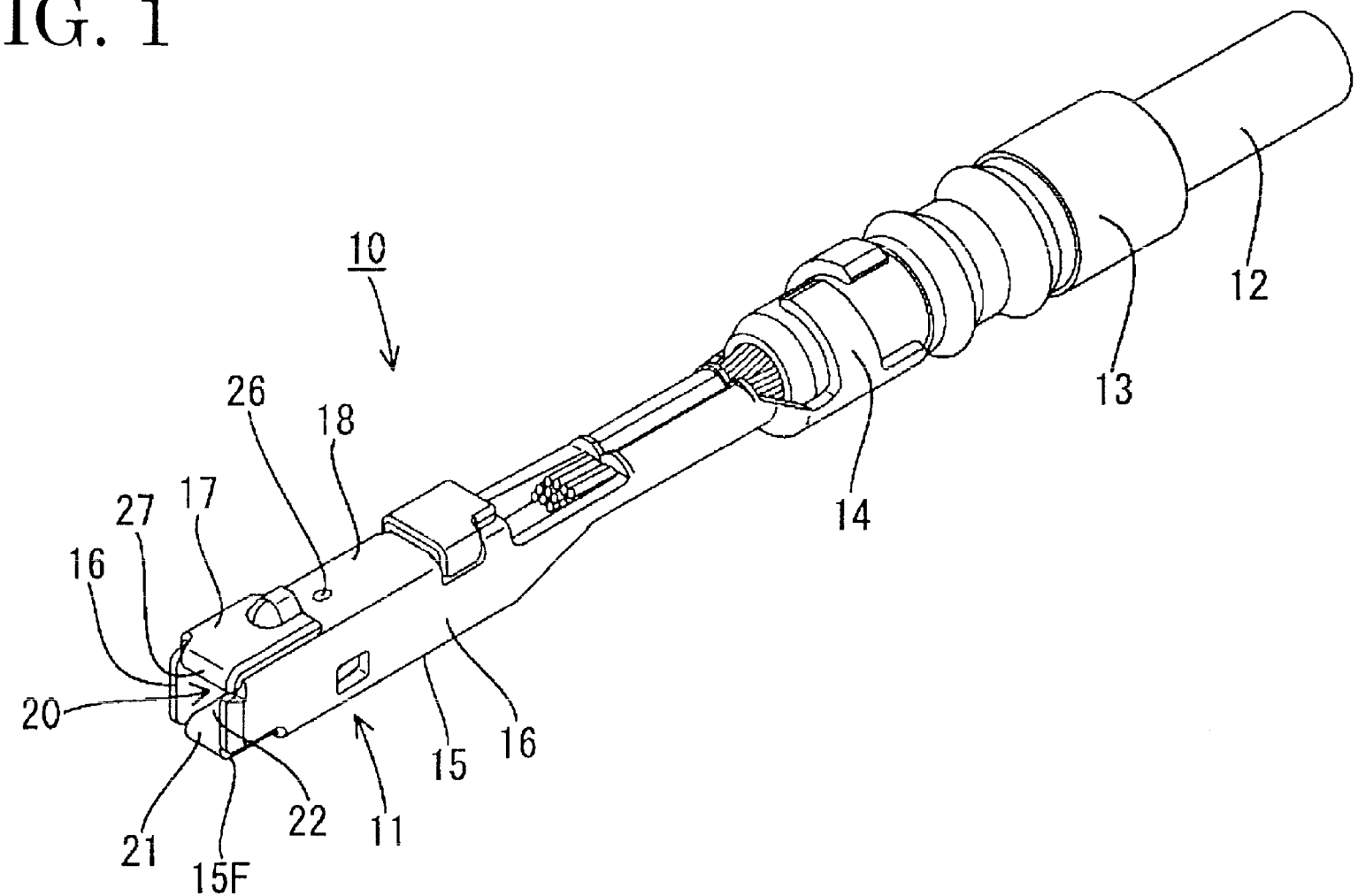
FIG. 1 is a perspective view of a first embodiment.
Figure 2:
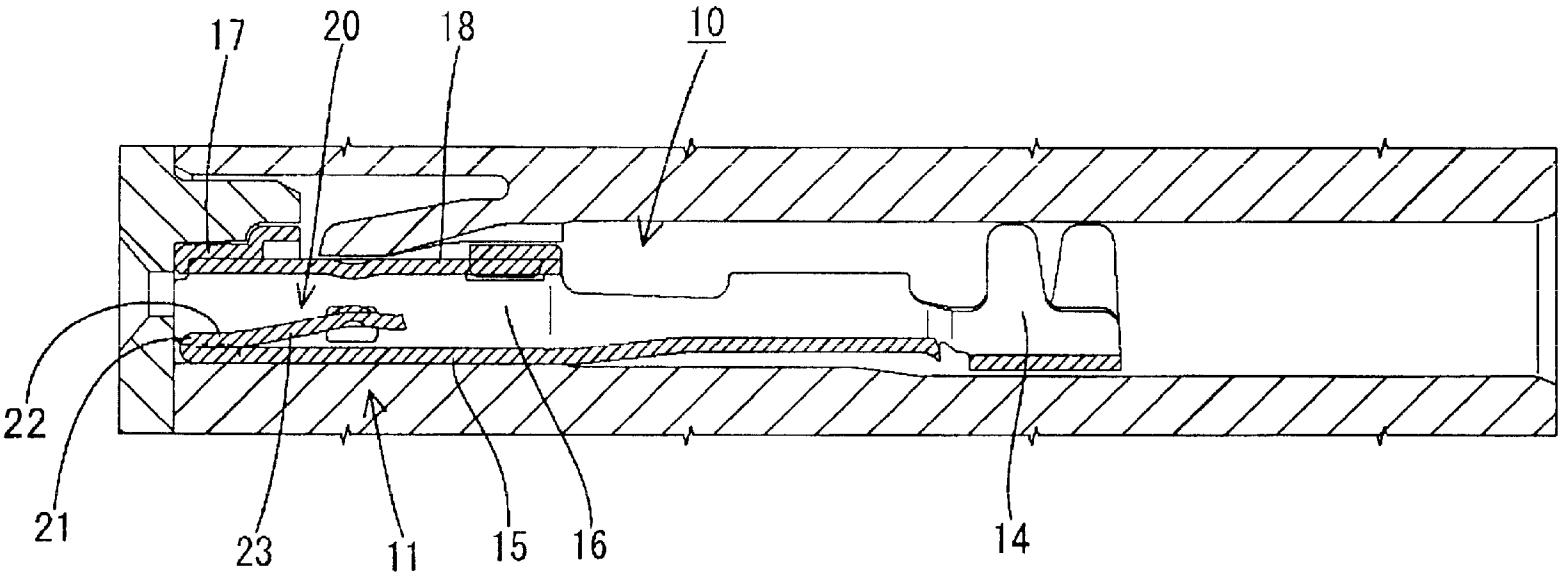
FIG. 2 is a section showing a state where a terminal fitting is inserted into a connector housing.
Figure 3:
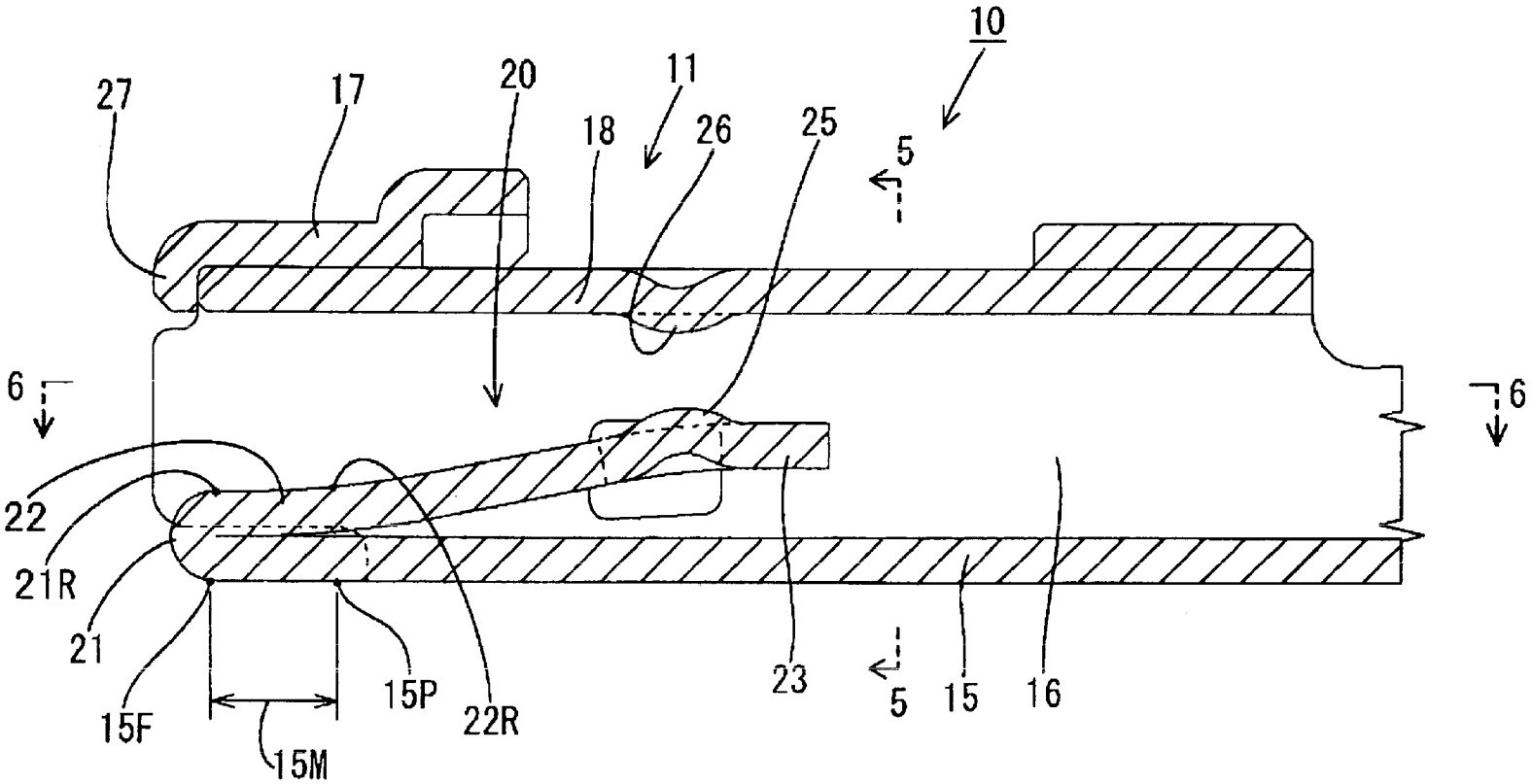
FIG. 3 is a partial enlarged section of the terminal fitting.
Figure 4:
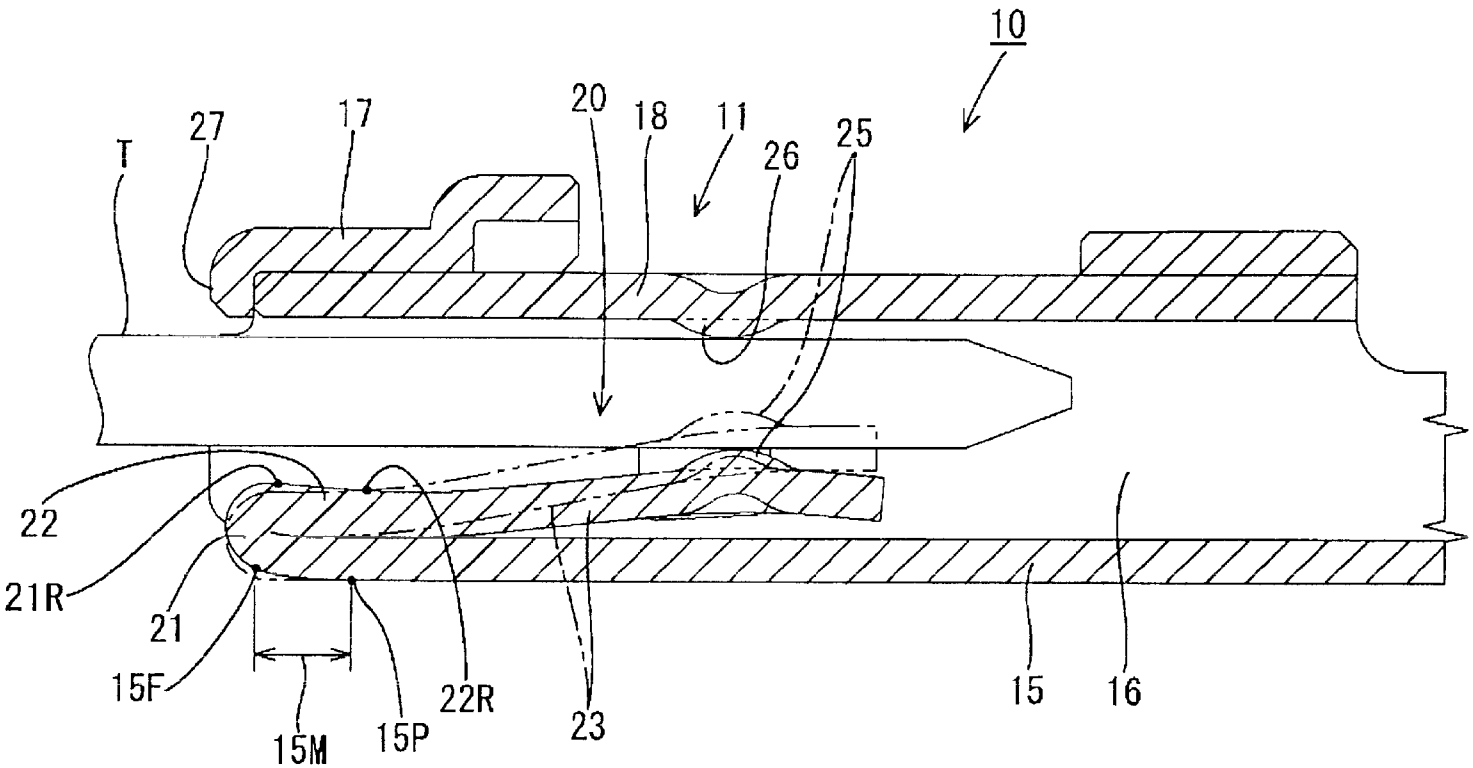
FIG. 4 is a partial enlarged section showing a state of the terminal fitting connected with a male tab.
Figure 5:
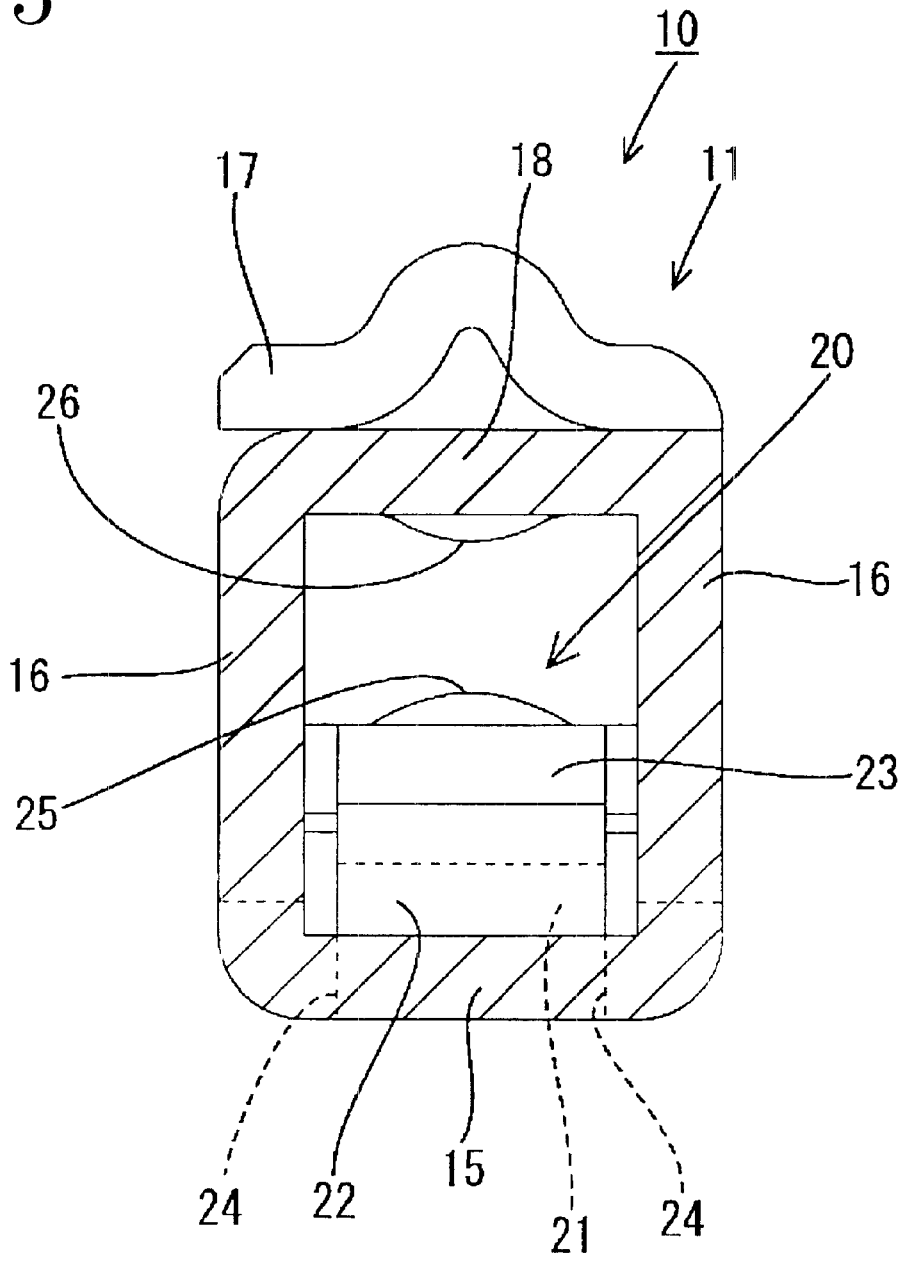
FIG. 5 is a lateral section along 5—5 of FIG. 3.
Figure 6:
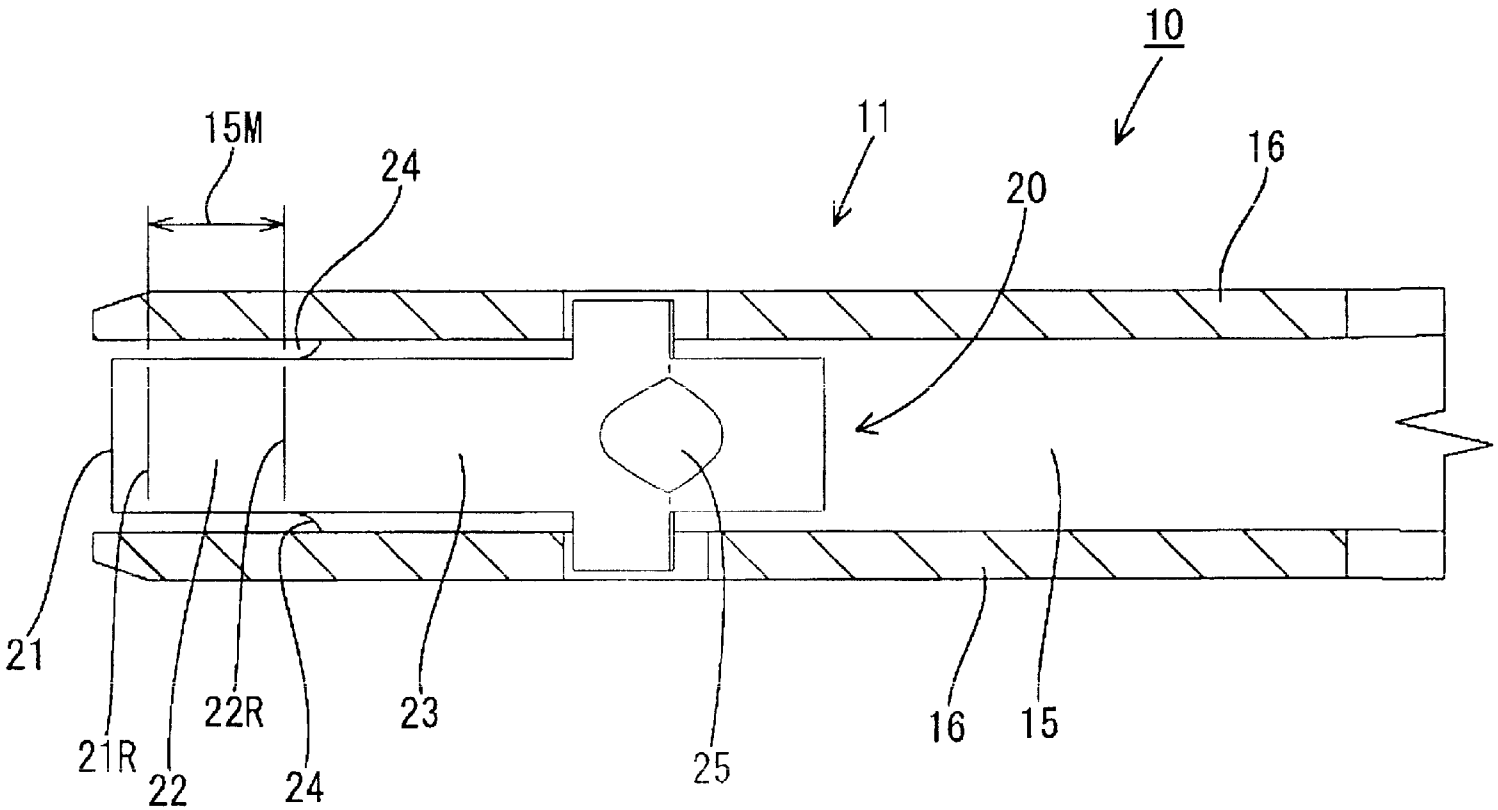
FIG. 6 is a horizontal section along 6—6 of FIG. 3.

A terminal fitting according to the invention is identified by the numeral 10 in FIGS. 1–10. The terminal fitting 10 is formed by bending a metallic plate material preferably punched out into a specified shape. A front portion of the terminal fitting 10 is formed to define a substantially rectangular tube 11. A rear portion of the terminal fitting 10 is formed to define a wire crimping portion 14 that is crimped into connection with a wire 12 and a rubber plug 13. In the following description, the left side in FIGS. 2 to 4 is referred to as the front and the vertical direction is based on the orientation in FIGS. 2 to 4. The terminal fitting 10 preferably has a width no greater than about 0.64 mm. Such terminal fittings preferably are used for a micro-connector.

The rectangular tube 11 is comprised of a substantially flat bottom wall 15 that is narrow in forward and backward directions. Two side walls 16 extend at substantially right angles from the left and right edges of the bottom wall 15. Two upper walls 17, 18 extend inwardly at substantially right angles from the upper edges of the opposite side walls 16 and are placed at least partly over one another. The rectangular tube 11 has an open front end and an open rear end. A resilient contact piece 20 is provided inside or toward the inside of the rectangular tube 11 and can be brought resiliently or elastically into contact with a male tab T inserted into the front of rectangular tube 11.

The resilient contact piece 20 is comprised of a curved portion 21 that is folded back at a front end 15F of the bottom wall 15 to extend obliquely back and up inside the rectangular tube 11. The curved portion 21 has a U-shape arcuate contour and is held closely in contact with the bottom wall 15. A touching portion 22 extends further back from an extending rear end 21R of the curved portion 21. The touching portion 22 is closely in contact with the upper surface of the bottom wall 15 over substantially the entire length of the touching portion 22. A contact portion 23 extends further back from an extending rear end 22R of the touching portion 22. The contact portion 23 is slanted to rise along its backwardly extending direction and to gradually separate from the upper surface of the bottom wall 15. With this construction, the resilient contact piece 20 has one end supported on the bottom wall 15.

The resilient contact piece 20 has a substantially constant width over its entire length and is slightly narrower than the distance between the inner surfaces of the side walls 16. Spacings between the left and right edges of the resilient contact piece 20 and the corresponding side walls 16 are equal.

The rectangular tube 11 is formed with a resiliently deformable front area along portions of the bottom wall 15 that are at least partly opposed to the curved portion 21 and the touching portion 22. More particularly, left and right slits 24 extend straight back parallel to the extending direction of the resilient contact piece 20 along the left and right edges from the front end 15F of the bottom wall 15. The slits 24 also extend along opposite side edges of the curved portion 21 and the touching portion 22. The slits 24 separate a front end area 15M of the bottom wall 15 from the left and right side walls 16. Thus, the front end area 15M of the bottom wall 15 is supported only at one end, and a position on the bottom wall 15 aligned with the rear ends of the slits 24 functions as a supporting or pivot point 15P. Therefore, the front end area 15M is resiliently or elastically deformable up and down toward and away from the inside of the rectangular tube 11.

The supporting point 15P for the resilient deformation of the front end area 15M of the bottom wall 15 is slightly behind the rear end 22R of the touching portion 22. As noted above, the rear end 22R of the touching portion 22 functions as a supporting point for the displacement of the contact portion 23. Thus, the resiliently deformable front end area 15M of the bottom wall 15 extends from the front end 15F of the bottom wall 15 to the rear end of the touching portion 22, which is the supporting point 22R for the displacement of the contact portion 23.

A rounded contact point 25 is formed at the extending end of the contact portion 23 by embossing a part of the contact portion 23 toward the upper surface. The lower surface of the male tab T inserted into the rectangular tube 11 is brought into contact with the contact point 25. The inner upper wall 18 also is formed with a rounded contact point 26 by embossing a part of the upper wall 18 toward the lower surface similar to the contact point 25 of the resilient contact piece 20. The upper surface of the male tab T inserted into the rectangular tube 11 is brought into contact with the contact point 26. The vertical distance between the contact points 25, 26 when the resilient contact piece 20 is not deformed is smaller than the thickness of the male tab T.

The outer upper wall 17 is formed with a protection edge 27 by bending its front end down substantially at right angles. The protection edge 27 is held in close contact with the front end surface of the inner upper wall 18 to prevent this front end surface from being exposed. This prevents the outer and inner upper walls 17, 18 from being separated vertically from each other when another member (not shown) strikes against the front ends of the upper walls 17, 18. Further, the outer surface of the protection edge 27 does not make a corner, but has an arcuate shape. Hence, there is no possibility of damaging another member that obliquely strikes against the front ends of the upper walls 17, 18 from a front upper side.

A male tab T inserted into the rectangular tube 11 from the front, as shown in FIG. 4, contacts the upper surface or contact point 25 of the contact portion 23. As a result, the contact portion 23 is pushed down about the rear end 22R of the touching portion 22 from a state shown in chained line in FIG. 4 to a state shown in solid line in FIG. 4. At this time, the rear end 22R of the touching portion 22, which is the supporting point for the displacement of the contact portion 23, is deformed resiliently to increase the angle between the contact portion 23 and the touching portion 22. Thus, resilient restoring forces raise the front end of the touching portion 22. The front end area 15M and the touching portion 22 have substantially the same length along forward and backward directions and are held in close contact with each other over their entire lengths. Accordingly, the front end area 15M of the bottom wall 15 is displaced together with the touching portion 22. Further, a specified contact pressure can be ensured between the resilient contact piece 20 and the male tab T by a resiliently restoring force of the resilient contact piece 20.

The front end area 15M of the bottom wall 15 is in face to face contact with the touching portion 22 when the terminal fitting 10 and the male tab T are connected. As a result, the curved portion 21 undergoes no resilient deformation. Accordingly, there is no possibility of concentrating stress on the curved portion 21. In this embodiment, the curved portion 21 is folded tightly back to minimize its radius of curvature. Thus, the height of the entire terminal fitting 10 is reduced by reducing the height of the resilient contact piece 20.

The front end area 15M of the bottom wall 15 also is deformed resiliently when the touching portion 22 is deformed its front end is raised as the contact portion 23 is displaced. Thus, concentration of a stress on the touching portion 22 is moderated.

The slits 24 separate the bottom wall 15 and the side walls 16 instead of causing the bottom wall to project forward from the rectangular tube, and the front end area 15M of the bottom wall 15 deforms resiliently. However, the side walls 16 are present on the opposite sides of the curved portion 21 and the touching portion 22 of the resilient contact piece 20. The presence of the side walls 16 prevents external matter from interfering with the curved portion 21 and the touching portion 22.

If the resiliently deformable area of the bottom wall 15 was limited to a position more toward the front end 15F of the bottom wall 15 than the supporting point 22R for the displacement of the contact portion 23, then the upper surface of the bottom wall 15 and the lower surface of the touching portion 22 could separate when the front end area 15M of the bottom wall 15 is deformed resiliently upward. As a result, the curved portion 21 could be deformed resiliently. However, the touching portion 22 never separates from the bottom wall 15 and does not cause the curved portion 21 to undergo a resilient deformation because the supporting or pivot point 15P for the resilient deformation of the bottom wall 15 and the supporting point 22R for the displacement of the contact portion 23 are set substantially at the same position.

The contact point 26 projects down from the inner upper wall 18 and faces the contact point 25 of the resilient contact piece 20. Thus, the male tab T is held in point contact with the terminal fitting 10 on its upper and lower surfaces. Therefore, a sliding insertion resistance that acts when the male tab T is inserted between the upper wall 18 and the resilient contact piece 20 can be reduced, and contact reliability is higher.

Figure 7:
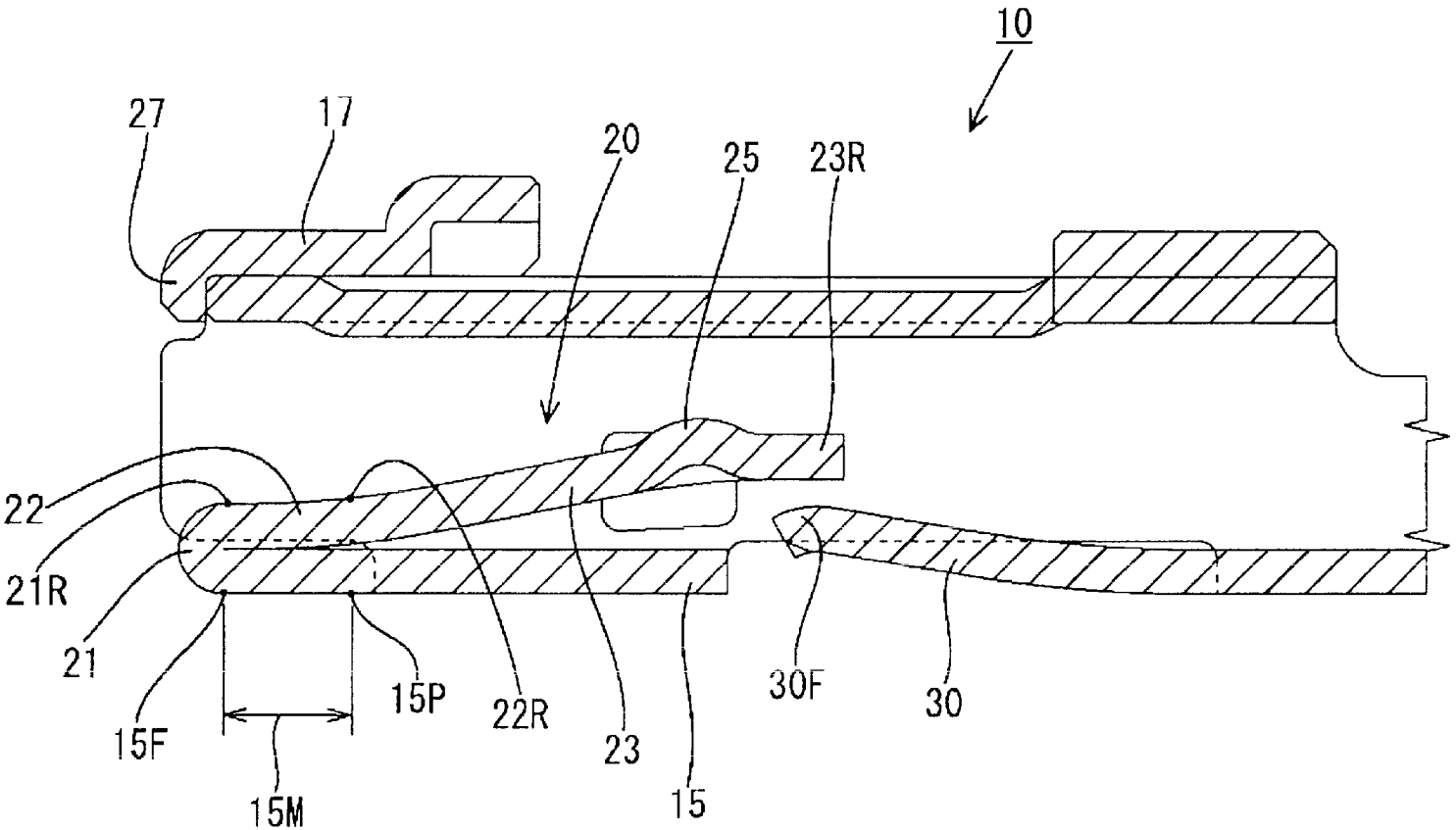
FIG. 7 is a partial enlarged section of a terminal fitting according to a second embodiment.

A second embodiment of the invention is illustrated in FIG. 7. The second embodiment differs from the first embodiment in that the bottom wall 15 is formed with an auxiliary spring portion 30. The auxiliary spring portion 30 is formed by cutting and bending or embossing the bottom wall 15 and cantilevers obliquely upward to the front. The extending front end 30F of the auxiliary spring portion 30 is slightly below the rear end 23R of the contact portion 23 in its free state where no force acts thereon. The rear end 23R of the contact portion 23 is displaced down upon the resilient deformation of the resilient contact piece 20 and contacts the extending end 30F of the auxiliary spring portion 30 from above. Thus, the auxiliary spring portion 30 is deformed resiliently downward. A high contact pressure can be ensured between the resilient contact piece 20 and the male tab T (not shown in FIG. 7) by the resilient restoring force of the auxiliary spring portion 30. The other construction is the same as or similar to the first embodiment, except that the contact point 26 is not formed on the upper wall 18. Consequently, no description is given on the structure, functions and effects of the same or similar construction, and they merely are identified by the same reference numerals. However, a contact portion 26 may be provided also on the upper wall 18.

Figure 8:
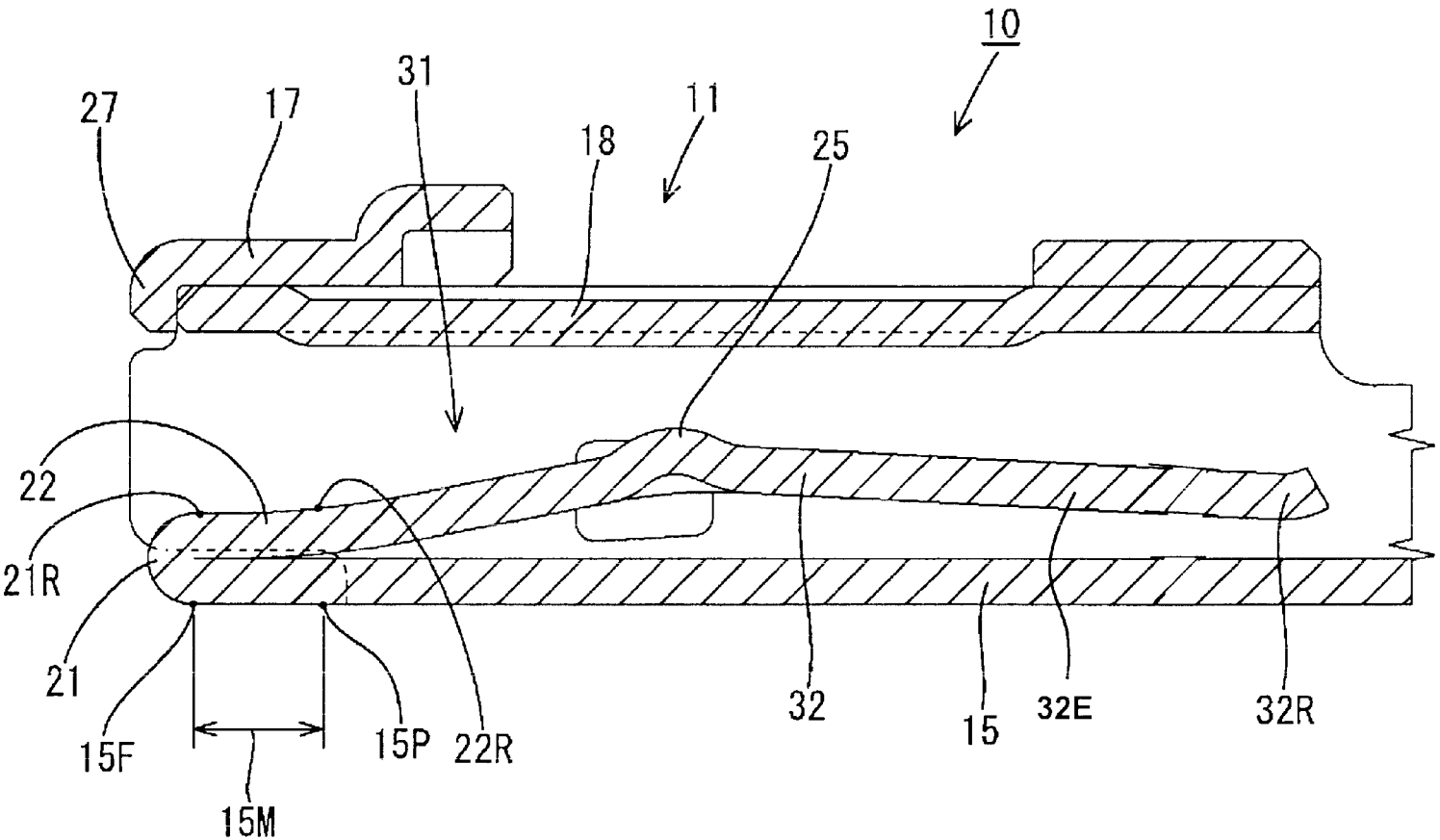
FIG. 8 is a partial enlarged section of a terminal fitting according to a third embodiment.

A third embodiment of the invention is illustrated in FIG. 8. In the third embodiment, an extending length of a contact portion 32 of a resilient contact piece 31 is longer than the contact portion 23 of the first embodiment, and an elongated portion 32E is so sloped down and back to approach the bottom wall 15 along an extending direction. Deformation of the resilient contact piece 31 causes the contact portion 32 to displace down. Thus, the extending rear end 32R of the contact portion 32 contacts the upper surface of the bottom wall 15, and the peak of the contact portion 32 adjacent the contact point 25 deforms resiliently to increase the distance to the upper wall 18. Consequently, the resilient restoring force of the contact portion 32 ensures a high contact pressure. The other construction of the third embodiment is the same as or similar to the first embodiment, except that the contact point 26 is not formed on the upper wall 18. Thus, no description is given of the identical or similar structure, functions and effects, and the same or similar elements merely are identified by the same reference numerals. However, a contact portion 26 may be provided also on the upper wall 18.

Figure 9:
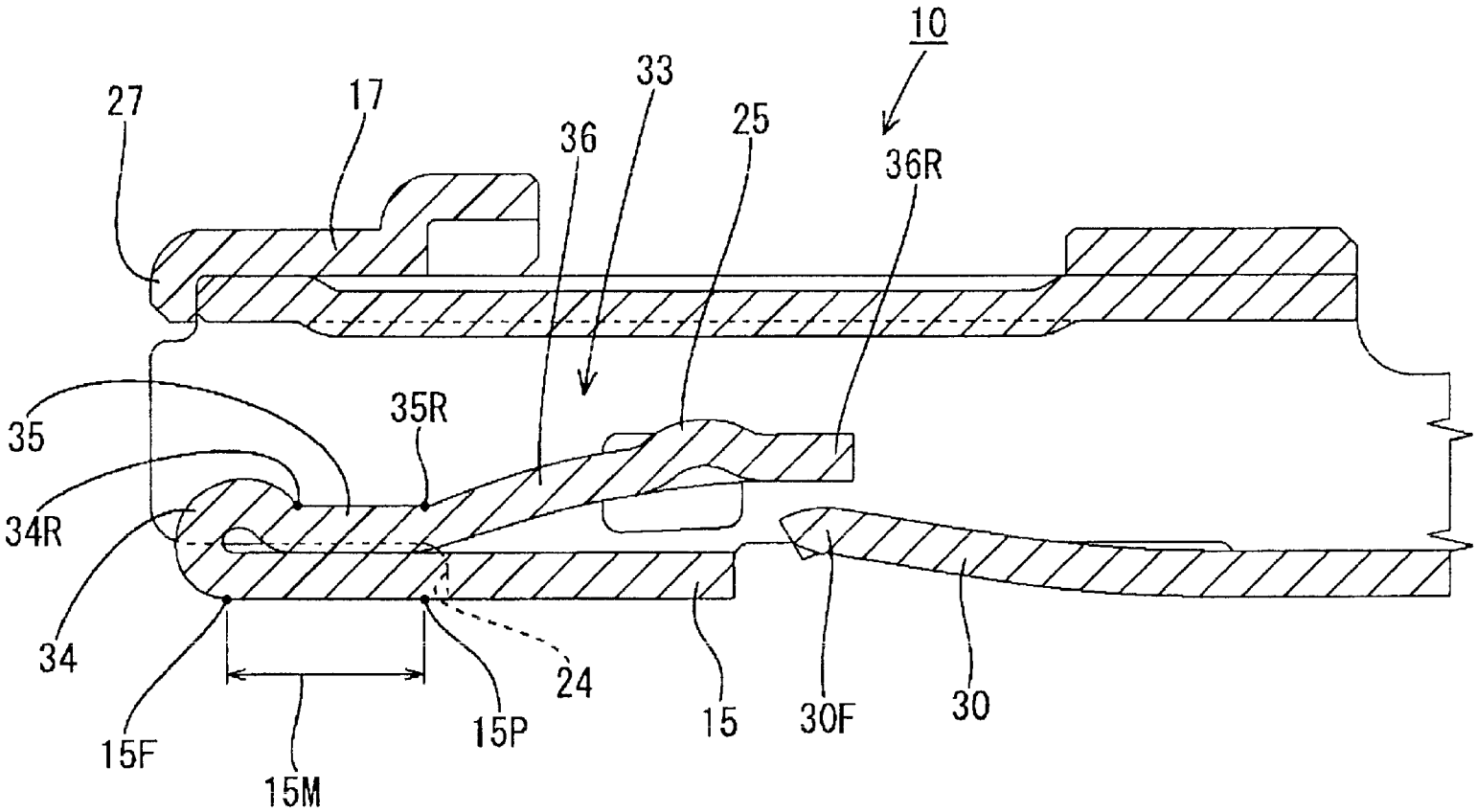
FIG. 9 is a partial enlarged section of a terminal fitting according to a fourth embodiment.
Figure 10:
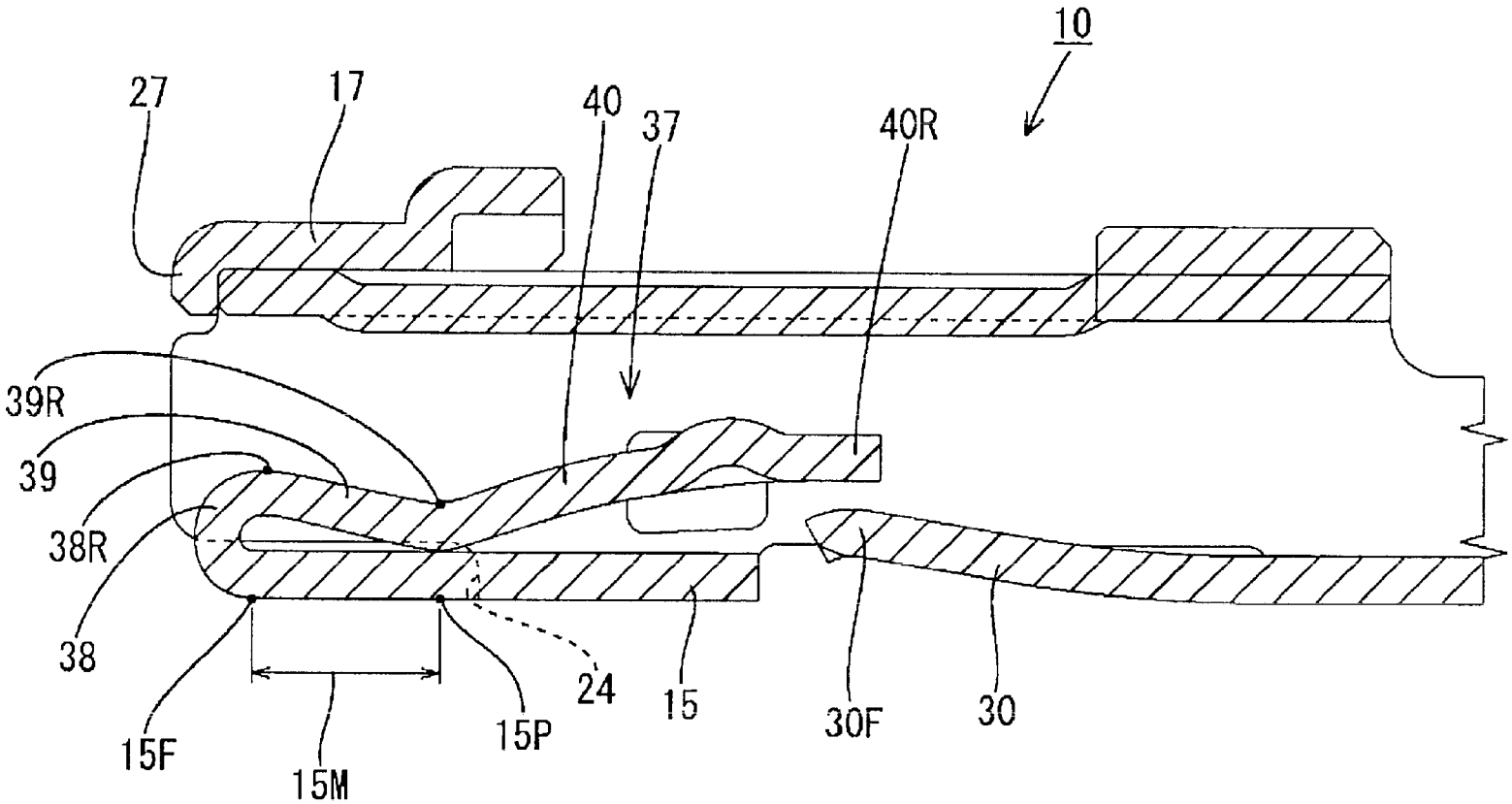
FIG. 10 is a partial enlarged section of a terminal fitting according to a fifth embodiment.

A fourth embodiment of the invention is illustrated in FIG. 9. A resilient or elastic contact piece 33 of this embodiment is constructed such that a curved portion 34 is folded back at the front end 15F of the bottom wall 15. The curved portion 34 has a radius of curvature larger than the curved portion 21 of the first embodiment, and only an extending end 39R of the touching portion 39 is held in close contact with the bottom wall 15. Thus, the curved portion 34 has a round or water drop shape when viewed from the side. A touching portion 35 extends further back from the extending end 34R of the curved portion 34. The touching portion 35 is held in close contact with the bottom wall 15 substantially over its entire length. A contact portion 36 extends further back from an extending end 35R of the touching portion 35. The contact portion 36 is slanted to gradually separate from the bottom wall 15 along its extending direction, and the front end 30F of the auxiliary spring portion 30 is located below the extending end 36R of the contact portion 36.

The rear end of the front end area 15M of the bottom wall 15 is the supporting point for both the displacement of the front end area 15M and the displacement of the contact portion 36, and is substantially at the same position as the rear end 35R of the touching portion 35 with respect to forward and backward directions. Further, the height or projecting distance of the curved portion 34 is set such that the male tab T does not interfere with the curved portion 34 while being in contact with the resilient contact piece 33. Since the other construction is the same or similar as that of the second embodiment, no description is given on the structure, functions and effects of the same construction by identifying it by the same or similar reference numerals.

The present invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

The bottom wall 15 is made at least partly resiliently or elastically deformable by the slits 24 that separate the bottom wall 15 and the side walls 16 forming the rectangular tube 11 in the foregoing embodiment. However, resiliency may be achieved by causing the bottom wall to project from the side walls without providing the side walls at the opposite sides of the curved portion and the touching portion.

The resiliently deformable area 15M of the bottom wall extends from the front end of the bottom wall 15 to the supporting point 15P for the displacement of the contact portion in the touching portion in the foregoing embodiments. However, the resiliently deformable area, i.e. the position of the supporting point for the resilient deformation of the bottom wall may be more toward the front end of the bottom wall than the supporting point for the displacement of the contact portion or conversely more backward than this supporting point.

What is claimed is:

1. A terminal fitting having opposite front and rear ends and comprising:

a support plate extending rearwardly from the front end of the terminal fitting;

opposed side plates extending from opposite side edges of the support plate and opposed to the support plate;

a top wall extending between the side plates;

a curved portion folded back from the support plate at the front end of the terminal fitting, the curved portion having an extending rear end;

a touching portion extending back from the extending rear end of the curved portion and being in face-to-face contact with the support plate, the touching portion having an extending rear end;

a contact portion extending back from the extending rear end of the touching portion and being spaced from the support plate, the contact portion having a rear end, an embossment being formed on the contact portion forwardly of the rear end for contact with a tab of a mating terminal; and an auxiliary spring cantilevered forwardly from a location on the support plate rearward of the rear end of the contact portion and being directed angularly up toward the contact portion, the auxiliary spring having a free front end and an upwardly convex curve adjacent the free front end, the upwardly convex curve being aligned with a section of the contact portion rearward of the embossment and being spaced from the contact portion by a distance less than a distance between the embossment and the top wall of the terminal fitting.

2. The terminal fitting of claim 1, wherein the side walls have front ends disposed substantially at the extending rear end of the touching portion, such that portions of the support plate extending from the front end of the terminal fitting to the side plates define a front area that is resiliently deformable.

3. The terminal fitting of claim 1, the top wall having an embossed portion, the embossed portion of the top wall and the embossment of the contact portion being spaced by a distance smaller than a width of the tab.

4. The terminal fitting of claim 1, wherein the curved portion is spaced from the top wall by a distance greater than a distance between the embossment of the contact portion and the top wall.

5. The terminal fitting of claim 1, further comprising slits formed between the support plate and the side plates and extending from the front end of the terminal fitting along opposite sides of the curved portion and the touching portion, the slits defining a front end area of the support plate that is resiliently deformable.

6. The terminal fitting of claim 5, wherein the resiliently deformable front end area of the support plate extends from the end of the terminal fitting to a supporting point for the displacement of the contact portion, the supporting point being located in the touching portion.

* * * * *